United States Patent [19]

Hesse et al.

[11] 3,951,488

[45] Apr. 20, 1976

[54] PLUG RECEPTACLE FOR A CONTACT RAIL ADAPTOR

[76] Inventors: Kurt Hesse, Waterfohr 38; Karl Wehling, Liegnitzer Str. 9, both of 492 Lemgo, Germany

[22] Filed: Apr. 22, 1974

[21] Appl. No.: 462,835

[30] Foreign Application Priority Data

Apr. 26, 1973 Germany ..... 2320981

[52] U.S. Cl. ..... 339/14 R; 339/42; 339/88 R; 339/139 C; 339/190

[51] Int. Cl.[2] ..... H01R 3/06; H01R 13/44; H01R 13/54

[58] Field of Search ..... 339/14, 42, 82, 197, 339/88, 139, 188 C, 189 R, 190, 20, 22 R, 22 B

[56] References Cited

UNITED STATES PATENTS

| | | | |
|---|---|---|---|
| 2,102,625 | 12/1937 | Hubbell | 339/14 RP |
| 3,273,103 | 9/1966 | Ericson | 339/22 B |
| 3,596,226 | 7/1971 | Meltzer | 339/22 B X |
| 3,613,045 | 10/1971 | Routh et al. | 339/22 B X |

FOREIGN PATENTS OR APPLICATIONS

| | | | |
|---|---|---|---|
| 1,223,412 | 6/1960 | France | 339/189 R |
| 233,790 | 5/1961 | Australia | 339/42 |

*Primary Examiner*—Joseph H. McGlynn
*Assistant Examiner*—Craig R. Feinberg
*Attorney, Agent, or Firm*—Elliott I. Pollock

[57] ABSTRACT

A plug receptacle for receiving an adaptor designed for insertion into an electrical contact rail comprises a metallic base plate having a pair of metallic arms affixed thereto and extending in spaced facing relation to one another outwardly of said plate. A central insulator member is attached to the base plate between the arms, extends from the base plate toward the spaced free ends of the arms, and cooperates with the portions of the arms outward of the free end of the insulator to define recesses which are complementary in shape and dimension to the opposed supporting clips of the adaptor. The insulator member includes a central opening in alignment with the space between the free ends of the arm, and supports a pair of electrical conductors which face said central opening and which are positioned for engagement by opposed electrical contacts of the adaptor when the adaptor is inserted between the free ends of the arms and rotated to turn the adaptor supporting clips into the recesses. An axially movable barrier member is disposed within the central opening of the insulator member and is urged by a spring toward a position outward of the base plate to cover the electrical conductors when no adaptor has been inserted. The complete receptacle may be covered by a hood which is detachably locked to the base plate and which includes a central aperture in alignment with the space between the free ends of the arms and with the central opening in the insulator member.

14 Claims, 9 Drawing Figures

PLUG RECEPTACLE FOR A CONTACT RAIL ADAPTOR

BACKGROUND OF THE INVENTION

Various electrical power distribution systems have been suggested heretofore which permit the selective positioning of electrical fixtures, such as lamps, at various locations along a track. The track has conventionally taken the form of an elongated metallic rail having interior webs which define ducts in which elongated electrical conductors are supported in insulated relation to the rail, and which further define support channels in spaced relation to the ducts cooperating with quick-release lockable adaptors arranged to mechanically and electrically secure the fixtures to the rail at desired locations.

In our copending application Ser. No. 462,920 filed Apr. 22, 1974 for Electrical Contact Rail, now abandoned, we have described a modified power distribution system particularly adapted for single-phase operation, which employs rail and adaptor components of comparatively small size, but which nevertheless assure that the certain minimum spacing between conductors specified by pertinent safety codes is maintained. The arrangement described and claimed in said copending application includes an elongated metal rail provided with interior webs defining elongated ducts containing insulating inserts which support elongated electrical conductors facing the interior of the rail, and which further define channels adapted to position an insertable adaptor with the adaptor contacts in engagement with the rail conductors; and the desired size reduction is achieved by providing one of the rail support channels with a stepped configuration cooperating with a complementarily step-shaped supporting clip on the adaptor, and by further providing the rail with an elongated grounding conductor which is inclined relative to the longitudinal center plane of the rail and which has one contact surface facing the interior of the rail and another contact surface facing the exterior of the rail.

In systems of the general type described, it is sometimes desirable to replace the contact rail, or to supplement the contact rail, by use of a plug-type receptacle mounted on the wall or ceiling and designed to receive a single adaptor which supports, and provides energization for, an electrical fixture at the specific location of the receptacle. Receptacles suggested for such use in the past have been arranged to receive the relatively large size adaptors which have been employed in prior art contact rail systems and, due to their resultant relatively large dimensions, such prior art receptacles are not capable of being used with the smaller size adaptors described in the aforementioned copending application. It is accordingly the primary object of the present invention to provide a new form of receptacle which can be used in place of, or as a supplement to, a comparatively small-sized contact rail, wherein the receptacle is constructed of a few easily mounted parts which are comparatively small in dimension and which can be manufactured at comparatively low cost, and wherein the receptacle is designed to receive and properly cooperate with such a smaller sized adaptor.

SUMMARY OF THE INVENTION

The receptacle of the present invention is adapted to be mounted on a wall or ceiling at a desired location, constitutes a female connector which includes components which perform the function of the support channels and electrical conductors of a contact rail, and is designed to receive a male-type adaptor of comparatively small size which adaptor can be inserted in a first position into the receptacle, thereafter turned through substantially 90° from its insertion position to mechanically support the adaptor on the receptacle and simultaneously effect electrical contact between the adaptor and receptacle, and which can then be fixedly locked in place by means of a clamping nut forming a portion of the adaptor.

The receptacle itself comprises a base plate arranged to be mounted on a wall and having a pair of arms extending in spaced, facing relation to one another outwardly of said plate in directions transverse to the plane of the base plate. The base plate, in the region between the arms, is provided with a shaped aperture through which a complementarily shaped block-like insulator member may be inserted, and the insulator member preferably includes resilient portions which snap over the edges of the base plate aperture as well as other portions which bear upon interior portions of the spaced arms, thereby to fixedly support the insulator member in position between the said arms.

The insulator member extends from the base plate toward the spaced free ends of the arms, with the end of the insulator member which is remote from the plate being located at a position between said plate and the free ends of the arms. The remote end of the insulator member cooperates with shaped portions of the arms outward of said remote end of the insulator to define opposed interior recesses which are respectively complementary in shape and dimension to the shapes and dimensions of the opposed supporting clips of the adaptor, thereby providing a structure in the receptacle which performs the function of the supporting channels in the contact rail. The insulator member further defines a central opening which is in alignment with the space between the free ends of the arms and which is positioned to receive a portion of the adaptor when the adaptor is inserted between the free ends of said arms, and a pair of electrical conductors are supported by said insulator member on opposite sides of the central opening for engagement respectively by the opposed contacts of the adaptor when the inserted adaptor is rotated to turn the adaptor supporting clips into said recesses, thereby to provide electrical connection between the adaptor and receptacle. In a preferred embodiment of the invention, the central opening of the insulator member further includes a movable barrier member of mushroom-shape, having a top portion which extends across the insulator opening, a stem portion which is mounted for axial sliding motion in a socket supported within the central opening adjacent the base plate, and a cooperating spring member which surrounds the socket and stem portion and which urges the cap portion outwardly of the base plate to conceal the electrical conductors prior to insertion of the adaptor. The adaptor, when inserted, bears upon the cap portion and depresses the barrier member, against the force of its associated spring, to permit the adaptor to electrically engage the conductors in the receptacle.

In a preferred form of the invention, the base plate and arms are fabricated of metal and are in electrical contact with one another. A grounding electrode is mounted on the free end of one of the arms, and a grounding terminal is mounted on the base plate. By this arrangement, there is no need for a separate grounding cable connecting the grounding electrode to the grounding terminal. The central insulating member, in addition to supporting the current-carrying conductors, is also preferably provided with contact terminals for the conductors which terminals are embedded in the insulator member at a position closely adjacent the base plate thereby to facilitate electrical connection to the electrical conductors, as well as to the grounding terminal, via cut-out portions of the base plate.

In a particularly pleasing embodiment of the invention, the arms, central insulator member, and base plate are covered by a contoured hood which is detachably connected to the base plate, and which is provided with a central aperture in alignment with the space between the free ends of the arms and in alignment with the central opening in the insulator member, to permit insertion of the adaptor.

BRIEF DESCRIPTION OF THE DRAWINGS

The foregoing objects, advantages, construction and operation of the present invention will become more readily apparent from the following description and accompanying drawings in which.

DESCRIPTION OF THE PREFERRED EMBODIMENTS

Figure 8:
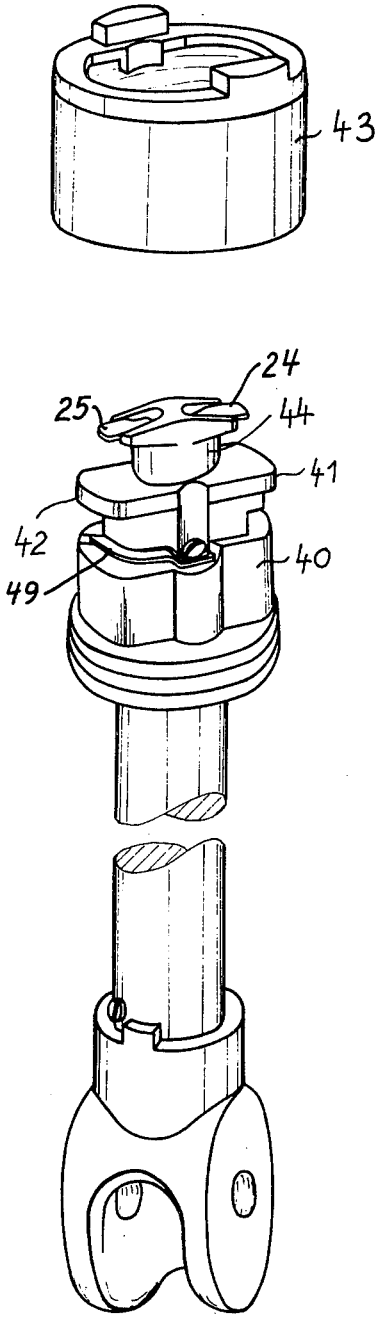
FIG. 8 is an enlarged view of an adaptor which can be inserted into the plug receptacle of the present invention.
Figure 9:
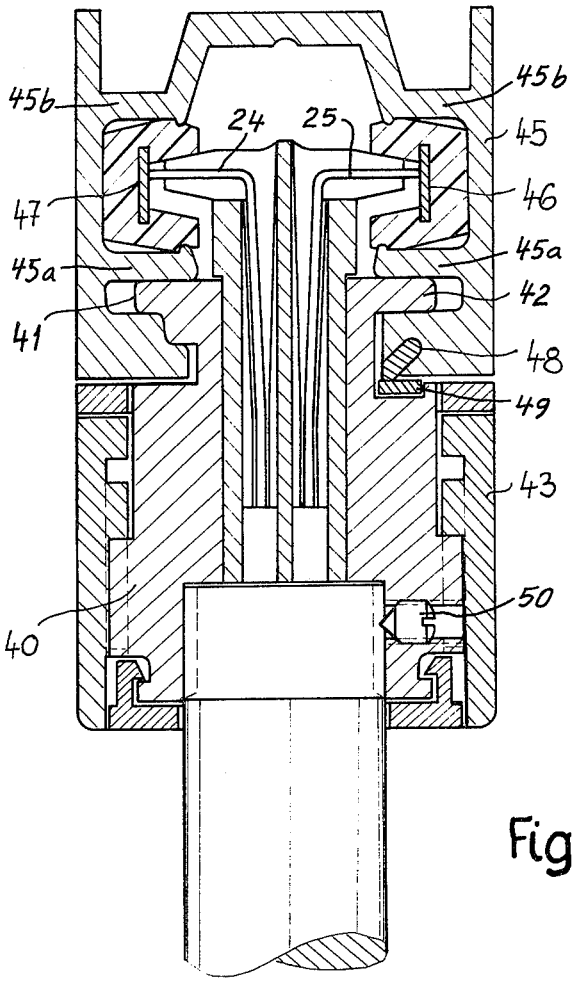
FIG. 9 is a longitudinal cross section of the adaptor shown in FIG. 8 inserted into a power distribution rail in accordance with our aforementioned copending U.S. application Ser. No. 462,920, now abandoned.

FIGS. 8 and 9 depict an adaptor of the type employed with the receptacle of the present invention, and show how such an adaptor may be associated with a contact rail rather than with the receptacle of the present invention. The adaptor is of comparatively small dimension and comprises a metal body 40 shaped to define a pair of opposed, radially extending retaining collars 41, 42. Collar 41 has a stepped configuration and is complementary in size and shape to a stepped supporting channel formed adjacent the lower left web of the rail 45 as viewed in FIG. 9. The opposing collar 42 is not stepped in configuration, and corresponds in dimension to the annular supporting groove located adjacent the opposite lowermost web of rail 45. This difference in the shapes of the two collars 41, 42 thus assures that the adaptor can be inserted into the rail 45 in only a single orientation relative to the rail.

The rail 45, at locations above the aforementioned support channels, includes interior webs 45*a*, 45*b* which define a pair of ducts containing insulator members which in turn support a pair of elongated conductors 46, 47 which are engaged by conductors 25, 24 respectively of the adaptor when the adaptor is inserted into the rail and turned through 90° to effect engagement between the adaptor supporting collars and rail support channels. More particularly, the adaptor includes a central tubular plastic insulator 44 which supports two L-shaped electrical contacts the lower ends of which are connected to appropriate cables within insulator 44, and the upper ends of which are bent at right angles to extend radially outward in opposing directions thereby to provide the aforementioned contacts 24, 25. The two electrical contacts 24, 25 are free to flex within insulator tube 44 and are so positioned relative to the remainder of the adaptor that they tend to resiliently engage the opposing rail conductors 46, 47 when the adaptor is locked into the rail.

The adaptor further includes an upwardly facing resilient grounding contact 49 which is positioned to fit snugly against a downwardly facing contact surface of a grounding conductor 48, supported in a lowermost web of rail 45, when the adaptor is properly installed into the rail. A metal tube is inserted into the lower end of the metallic body 40 and is held in place by a set screw 50 (see FIG. 9) and said metal tube extends downwardly from the rail when the adaptor is locked into the rail, to support an appliance such as a lamp from and below the rail 45. The adaptor further includes a plastic clamping nut 43 which has an interiorly threaded surface in thread engagement with the adaptor at the lower end of metal body 40. Clamping nut 43 is associated with a plastic washer which is arranged to be moved in an axial direction along the adaptor as the nut 43 is screwed upwardly or downwardly, but which is restrained against rotational motion about metal body 40; and the upper surface of the washer is provided with a pair of upstanding projections (see FIG. 8) which are dimensioned to fit between the facing edges of the lowermost webs in rail 45 when the adaptor is completely installed. To install the adaptor into the rail, the upper portion of the adaptor is inserted between the opposing lower edges of the webs at the bottom of the rail with the retaining collars 41, 42 extending in the longitudinal direction of the rail, the adaptor is then rotated through 90° to cause the collars 41, 42 to be turned into their associated rail support channels thereby simultaneously to effect electrical contact between adaptor contacts 24, 25 and the rail conductors 47, 46, and between adaptor ground contact 49 and the rail grounding contact 48, whereafter clamping nut 43 is tightened upwardly along body 40 to force its associated washer against the bottom surfaces of the lowermost webs in the rail with the upstanding projections of said washer being disposed between the facing interior edges of said lowermost webs, thereby to securely hold the adaptor in place.

The present invention is directed to a receptacle which can be used in place of, or as a supplement to, the rail 45 shown in FIG. 9. The receptacle is designed to receive an adaptor which is constructed in accordance with FIG. 8, and which supports a single electrical fixture at the location of the receptacle following a similar series of manipulative steps i.e., the adaptor is longitudinally inserted into the receptacle, turned through 90° to effect mechanical and electrical connection between the adaptor and receptacle, and is then locked in place by turning clamping nut 43 into forcible engagement with the receptacle. A receptacle adapted for this form of operation is shown in FIGS. 1–7 inclusive, like numerals of which refer to like parts throughout.

Figure 6:
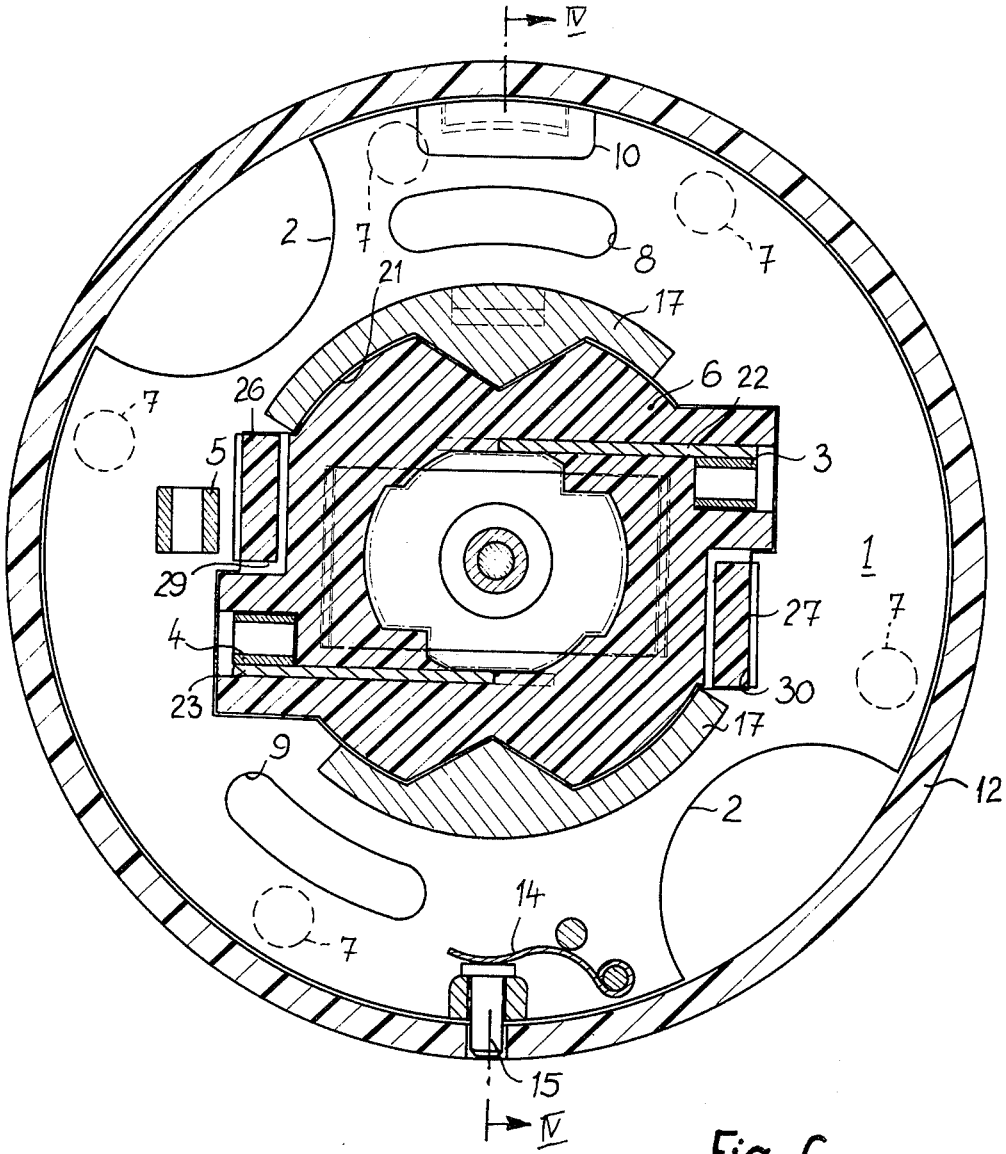
FIG. 6 is a cross sectional view taken along plane VI—VI of FIG. 4.
Figure 7:
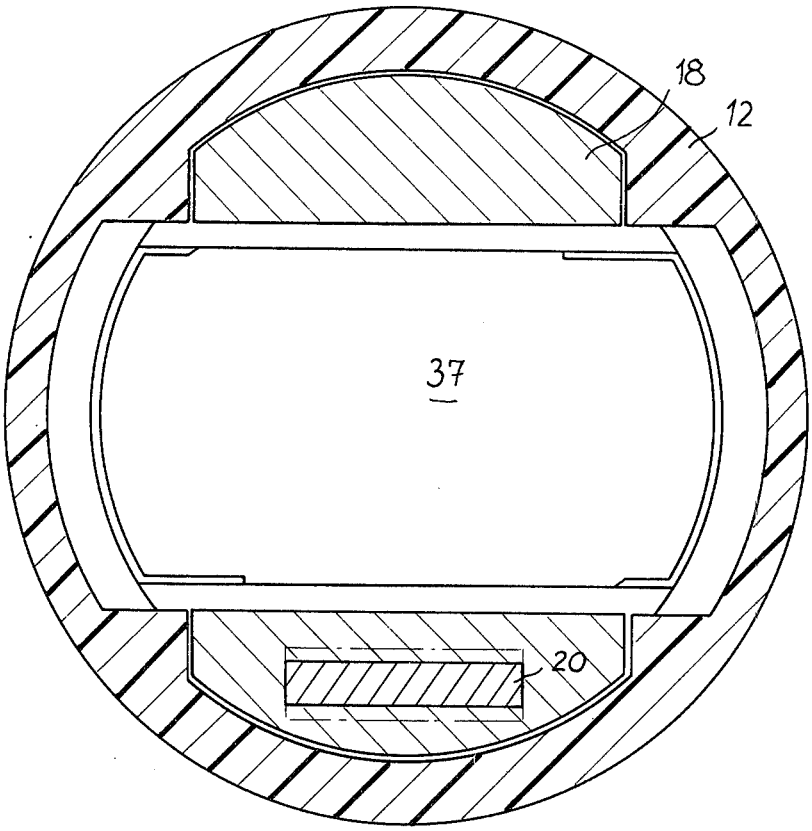
FIG. 7 is a cross sectional view taken along plane VII—VII of FIG. 4.

The receptacle comprises a circular, metallic base plate 1 provided with half-round break-outs 2 adjacent its rim through which leads (not shown) extend to electrical contact terminals 3, 4 embedded within a centrally located insulator member 6, and to an electrical grounding terminal 5 which is mounted directly on metallic base plate 1. The terminals 3, 4, and 5 are best shown in FIG. 6. The base plate includes a pair of oblong holes 8 and 9 through which fastening screws may extend to attach the base plate to the wall or ceiling, and the lower surface of base plate 1 is provided with a plurality of outwardly protruding pins 7 which maintain the base plate at a desired distance from its support.

Figure 1:
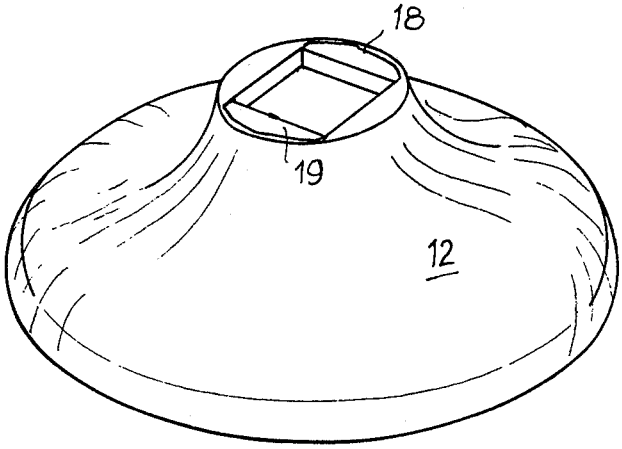
FIG. 1 is a perspective view of the receptacle of the present invention with the covering hood in place.
Figure 2:
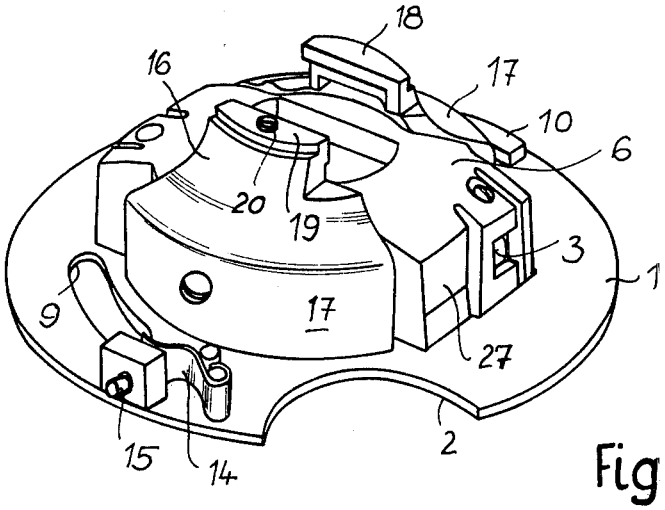
FIG. 2 is a perspective view of the receptacle with the hood removed.
Figure 3:
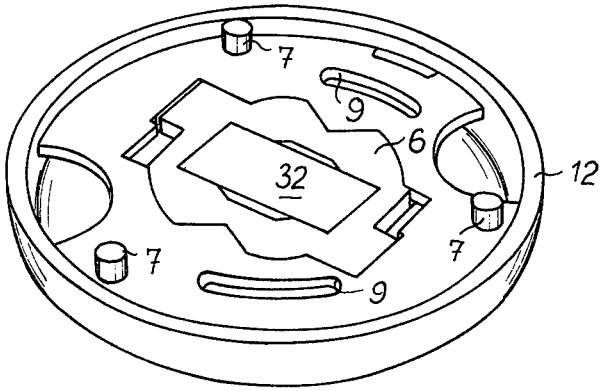
FIG. 3 is a bottom view of the receptacle.
Figure 4:
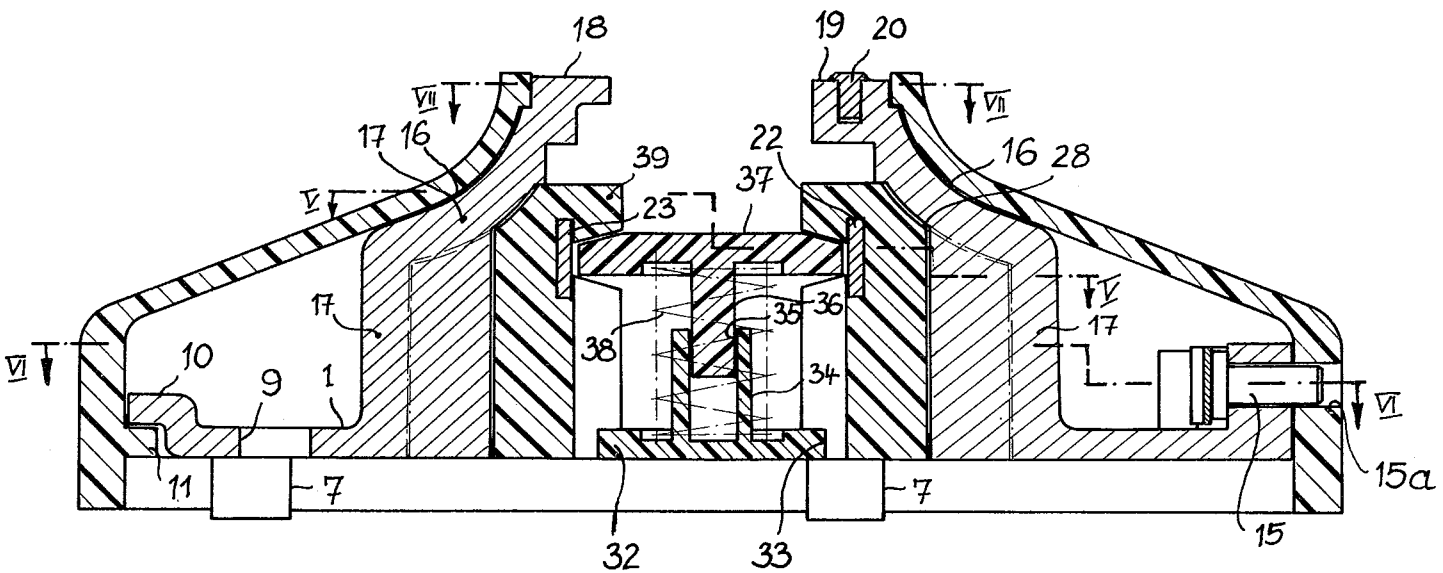
FIG. 4 is a longitudinal cross section of the receptacle with the hood in place, taken across the center of the receptacle through plane IV—IV of FIG. 6.

The base plate 1, and the various elements supported thereon (to be described) is covered by a contoured hood 12 which is detachably connected to the base plate. As best shown in FIG. 4, the base plate may be provided with a retaining hook 10 which is shaped and positioned for engagement with a projection 11 outstanding from the hood 12 adjacent its rim, and the opposite side of the base plate is provided with a pin 15 which is urged radially outward by a leaf spring 14 (see FIGS. 2 and 6) for entry into an aperture 15a formed in the hood 12 at a position opposite projection 11. the As best shown in FIG. 4, the hood 12 is contoured to engage and rest upon surfaces 16 of a pair of segmentally shaped metallic arms 17 which are integral with and rise from the metallic base plate 1 in spaced facing relation to one another and in a direction transverse to the plane of base plate 1. The lower ends of the arms 17, adjacent their junction with base plate 1, are of circular-cylindrical shape and are provided on their interiors with segmentally shaped recesses (see especially FIGS. 5 and 6). At their upper regions, each arm changes from a circular cylindrical shape into the shape of a curved truncated cone which again contains segmentally shaped recesses. At their outermost free ends, the arms 17 are shaped to define, in cooperation with inwardly protruding portions 39 at the outermost free end of insulator 6, a pair of opposed, horizontal, spaced supporting clips 18 and 19 the interiors of which consititute shaped recesses (one of stepped configuration and the other of unstepped, annular configuration) which correspond in cross sectional shape to the shape of the complementary supporting clips 41, 42 on the adaptor (see FIGS. 8 and 9). Hood 12, as best shown in FIG. 1, defines an aperture which is in alignment with the space between clips 18, 19; and therefore an adaptor may be inserted into the space between clips 18 and 19 via the hood aperture, whereafter said adaptor may be turned through 90° to lock its supporting clips into the complementary clips 18, 19 of the receptacle.

A grounding contact 20 is located at the outermost free end of one of the arms 17, i.e., adjacent clip 19, and is positioned for engagement by grounding contact 49 of the adaptor when the adaptor has been inserted and turned into its locked position. Contact 20 is in electrical continuity, via metallic arms 17 and metallic base plate 1, with ground terminal 5 on said base plate, and therefore no separate grounding cable need be provided between contact 20 and its associated terminal 5.

Figure 5:
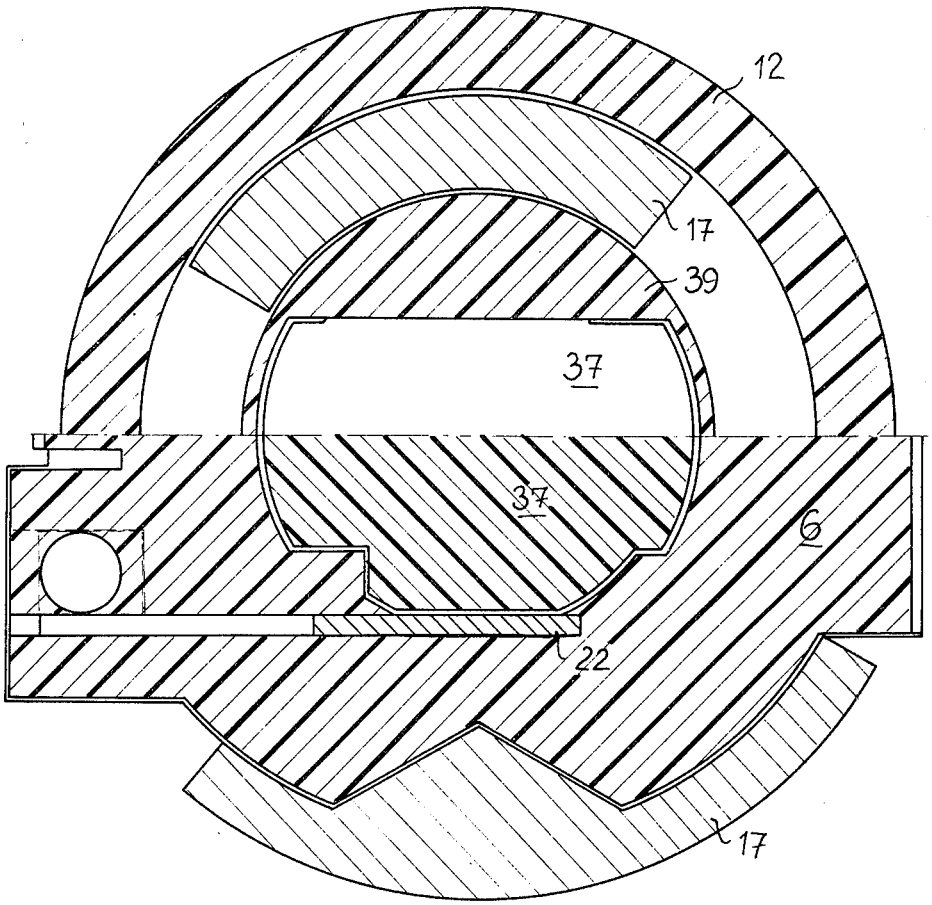
FIG. 5 is a cross section of the receptacle taken along plane V—V of FIG. 4.

The two arms 17 embrace a central insulator member 6 the external profile of which is complementary to the internal profile of arms 17 as best shown in FIGS. 5 and 6. Central insulator member 6 extends through an opening 21 formed in the base plate and is shaped to correspond, substantially, to the exterior profile of insulator 6 (see FIG. 6). The exterior of the insulator member includes two sections 26, 27 which are integral with the remainder of the insulator member but which a are partially separated therefrom to cause sections 26, 27 to exhibit a certain resilience; and these resilient sections 26, 27, which are slightly conical in shape, are dimensioned to protrude over edge portions 29, 30 of base plate opening 21 when the insulator has been inserted through said opening 21. When the insulator member 6 is inserted into the base plate opening, therefore, resilient sections 26, 27 will yield somewhat and, after insulator member 6 has been sufficiently advanced through the opening 21, will snap over edge portions 29, 30 of opening 21 to prevent the central insulator section from being withdrawn. At this same time, the curved bevel portion 28 adjacent the exterior of the free end of the insulator member 6 will bear upon the complementarily shaped internal, truncated-conical regions of arms 17 to prevent any further advance of central insulator member 6 toward supporting clips 18, 19. The central insulator member can thus be readily inserted in place via base plate opening 21, and is automatically and firmly locked in desired position by the cooperative action of resilient sections 26, 27 and edge portions 29, 30 of opening 21 at one end of the insulator member, by the cooperating action of the beveled portion 28 of the insulator member and the facing internal regions of the arms 17 adjacent the other end of the insulator member, and by the complementarily shaped exterior profile of the insulator member and cooperating segmentally shaped recesses on the interiors of arms 17 in the region between opposing ends of insulator member 6.

Insulator member 6 has a central opening which is in alignment with the sapce between supporting slips 18, 19, and supports a pair of electrical conductors 22, 23, which are embedded into the insulator member 6 and which include end portions that are exposed via the central insulator opening for contact with adaptor contacts 24, 25. The embedded conductors 22, 23 are in direct electrical contact with terminals 3, 4 which are similarly embedded into insulator member 6 as best shown in FIG. 6.

In a preferred form of the invention, the central opening in insulator member 6 includes an axially slidable barrier member which hides conductors 22, 23 when no adaptor is inserted into the receptacle, but which is arranged to be depressed upon insertion of an adaptor to expose conductors 22, 23 for electrical contact with the adaptor. The barrier member, which is best shown in FIG. 4, is of mushroom shape, and constitutes a cap portion 37 which extends across the central opening of the insulator 6. Cap portion 37 is integral with an axially extending stem portion 36 which is slidable in a guide bore or socket 35 defined in a stud 34 extending axially from a plate 32 which is of rectangular shape and which is inserted into and locked into a corresponding opening 33 in the bottom of the insulator (see FIGS. 3 and 4). The stem portion 36 and socket 35 are shaped to provide cooperating cam surfaces which permit the barrier member 36, 37 to be moved in an axial direction, and which prevent rotational motion of said barrier member.

A compression spring 38 is disposed in surrounding relation to stud 34 and stem portion 36, and extends between retaining recesses provided in the facing surfaces of plate 32 and cap portion 37, to resiliently urge cap portion 37 outwardly of base plate 1 and into engagement with the inner surfaces of inwardly protruding parts 39 of insulator member 6, adjacent to embedded conductors 22, 23, when the adaptor is not in place. When the adaptor is inserted, however, the entry end of the adaptor engages cap portion 37 and depresses the slidable barrier member toward base plate 1 against the force of spring 38 to expose electrical conductors 22, 23 for contact with the adaptor contacts.

We claim:

1. An electrical power distribution system comprising, in combination, an individual plug receptacle adapted to be mounted on a wall or the like and constructed to receive only a single adaptor and an adaptor for insertion into said receptacle, said adaptor comprising an elongated body having a pair of opposed radially extending supporting clips for selective insertion into spaced support channels in the receptacle and also having a pair of opposed radially extending contacts spaced from one another and from the supporting clips for engaging spaced electrical conductors in the receptacle when the adaptor supporting clips are inserted into the support channels, the adaptor being insertable longitudinally into said receptacle in a first position wherein said radially extending clips and contacts are initially radially spaced form said support channels and conductors respectively whereafter the adaptor may be rotated about its longitudinal axis to turn said radially extending clips and contacts into engagement with said receptacle channels and conductors respectively, said receptacle comrising a base plate having means for mounting said base plate in substantially flush engagement with a wall or the like, a pair of arms attached to said base plate and extending in spaced, facing relation to one another outwardly of said base plate in directions transverse to the plane of said base plate, a central insulator block attached to said base plate between said arms and extending from said base plate away from said mounting means toward the spaced free ends of said arms remote from said plate, the free end of said insulator block remote from said plate terminating at a position located between said plate and said free ends of said arms and cooperating with the portions of said arms outward of said free end of said block to define opposed interior recesses between the free end of said insulator block and the free ends of said arms, said interior recesses being respectively complementary in shape and dimension to the shapes and dimensions of the opposed supporting clips of the adaptor and constituting said spaced support channels, said central insulator block defining an interior central opening in alignment with the space between the free ends of said arms for receiving a portion of the adaptor when the adaptor is inserted longitudinally between the spaced free ends of said arms and into said opening, and a pair of electrical conductors supported within said insulator block on opposite sides of said central opening, said conductors being accessible through said central opening for engagement respectively by the opposed radially extending contacts of the adaptor when the inserted adaptor is thereafter rotated to turn the adaptor supporting clips into said recesses.

2. The combination of claim 1 wherein said receptacle includes including a movable barrier member disposed within said central opening of said insulator block for movement in an axial direction in the region between said base plate and said recesses, and resilient means for urging said barrier member outwardly of said base plate toward a position wherein said barrier member covers said pair of electrical conductors.

3. The combination of claim 2 including means for preventing rotational movement of said movable barrier member.

4. The combination of claim 2 wherein said barrier member is of mushroom configuration and comprises a cap portion having a periphery which is complementary in shape to said opening and a stem portion which extends from said cap portion toward said base plate, and means on said base plate defining an axially extending socket, said stem portion being slidable in an axial direction in said socket, said resilient means comprising a coil spring surrounding said socket and stem portion and extending between said base plate and said cap portion, the end of said insulator block remote from said base plate having a radially inwardly extending flange located between said recesses and said conductors for limiting movement of said cap portion in a direction outward of said base plate.

5. The combination of claim 1 including a grounding contact mounted on the free end of one of said arms.

6. The combination of claim 5 wherein said arms and said base plate are each fabricated of metal, and a grounding terminal mounted on said base plate in electrical continuity with said grounding contact via said base plate and said one of said arms.

7. The combination of claim 1 wherein the exterior of said insulator block is in surface engagement with and shaped to conform to the interior of said pair of arms.

8. The combination of claim 1 including a hood covering said arms and said insulator block, said hood including a portion in surface engagement with and shaped to conform to exterior portions of said arms, said hood defining an aperture in alignment with the space between the free ends of said arms for reception of an adaptor through said aperture into said space and into the central opening of said central insulator block.

9. The combination of claim 8 wherein said hood is attached to said base plate.

10. The combination of claim 9 wherein said hood and base plate are each circular in configuration, said hood including a first edge portion in separable engagement with said base plate, and a spring-loaded pin for removably locking a second edge portion, diametrically opposed to said first edge portion, to said base plate.

11. The combination of claim 1 wherein said insulator block includes a pair of terminals embedded therein, said terminals being electrically connected to said pair of electrical connectors respectively.

12. The combination of claim 1 wherein said arms and said base plate are integral with one another and fabricated of metal, each of said arms being shaped adjacent said base plate in the form of a cylindrical segment, the portion of each arm adjacent its free end being shaped in the form of a segment of a curved truncated cone.

13. The combination of claim 1 wherein said base plate is fabricated of metal and includes a central opening shaped in substantial conformity with the exterior of said insulator block, said insulator block extending through said base plate opening into the region between said arms, and means for removably attaching said insulator block to said metallic base plate adjacent said base plate opening.

14. The combination of claim 13 wherein said insulator block includes resilient portions positioned to overlie the edge of said base plate opening to attach said insulator member block to said base plate.

* * * * *